US006257341B1

(12) United States Patent
Bennett

(10) Patent No.: US 6,257,341 B1
(45) Date of Patent: Jul. 10, 2001

(54) COMPACT AFFORDABLE INERT GAS FIRE EXTINGUISHING SYSTEM

(76) Inventor: Joseph Michael Bennett, 5722 Craigmont Ct., Huber Heights, OH (US) 45424

( * ) Notice: Subject to any disclaimer, the term of this patent is extended or adjusted under 35 U.S.C. 154(b) by 0 days.

(21) Appl. No.: 09/489,492

(22) Filed: Jan. 21, 2000

Related U.S. Application Data

(63) Continuation-in-part of application No. 09/158,677, filed on Sep. 22, 1998, now Pat. No. 6,016,874.

(51) Int. Cl.[7] ..... A62C 35/58
(52) U.S. Cl. ..... 169/85; 169/88
(58) Field of Search ..... 169/85, 88

(56) References Cited

U.S. PATENT DOCUMENTS

| | | | | |
|---|---|---|---|---|
| 1,839,658 | | 1/1932 | Pugas | 169/15 |
| 2,841,227 | | 7/1958 | Betzier | 169/85 |
| 3,255,824 | | 6/1966 | Rogers | 169/85 |
| 3,741,585 | | 6/1973 | Hendrickson et al. | 280/150 |
| 3,806,461 | | 4/1974 | Hendrickson et al. | 252/188.3 |
| 3,972,820 | | 8/1976 | Filter et al. | 252/5 |
| 4,064,658 | | 12/1977 | McClure et al. | 169/85 |
| 4,224,994 | | 9/1980 | Tone | 169/88 |
| 4,505,336 | * | 3/1985 | Thevis et al. | 169/85 |
| 4,601,344 | | 7/1986 | Reed et al. | 169/47 |
| 4,807,706 | | 2/1989 | Lamberson et al. | 169/45 |
| 4,909,549 | | 3/1990 | Poole et al. | 280/738 |
| 4,931,111 | | 6/1990 | Poole et al. | 149/35 |
| 5,035,751 | | 7/1991 | Pool | 149/46 |
| 5,495,893 | * | 3/1996 | Roberts et al. | 169/37 |
| 5,957,210 | * | 9/1999 | Cohrt et al. | 169/44 |
| 6,016,874 | * | 1/2000 | Bennett | 169/77 |

* cited by examiner

*Primary Examiner*—Patrick Brinson
*Assistant Examiner*—Davis Hwu

(57) ABSTRACT

A compact, affordable fire extinguishing system utilizes a combination of compressed inert gas tanks and solid propellent gas generator s to provide a blend of inert gasses to extinguish fires in an enclosure. The compressed inert gas tanks may contain gasses such as argon or carbon dioxide or a combination thereof The solid propellent gas generators may generate upon initiation either nitrogen or carbon dioxide or a combination thereof. The inert gasses from both sources are blended into a composition that will extinguish fires at concentrations that will allow human occupancy during discharge. Such a system can be constructed at a substantially smaller size than conventional compressed gas systems, due to the greater density of the inert gasses in the propellent foii in storage, which allows greater utility and affordability where installation space is limited or retrofit is desired into prior fire protection systems.

29 Claims, 2 Drawing Sheets

COMPACT AFFORDABLE INERT GAS FIRE EXTINGUISHING SYSTEM

This is a continuation-in-part to U.S. Ser. No. 09/158,677 filed Sep. 22, 1998 now U.S. Pat. No. 6,016,874.

BACKGROUND OF THE INVENTION

1. Field of the Invention

The present Invention relates to a fire extinguisher system. More specifically, the present invention relates to a fixed fire extinguishing system delivering an inert gas composition suitable for use in occupied spaces by means of a particular combination of stored gas containers and solid propellant inert gas generators to provide the most compact system possible.

2. Related Art

Halogenated fluorocarbon g,ases such as bromotrifluoromethane ($CF_3Br$) have been used to provide fire extinguishing capability for the majority of this century. These gases, which chemically inhibit fires, provide high efficiency and compact systems that can be placed in small storage areas. In addition, the very low toxicity of such substances has allowed their use to protect compartments nonnally occupied by humans, such as computer rooms, libraries and vehicles. These applications comprise a large portion of the fire protection market. Unfortunately, recent discoveries of stratospheric ozone depletion attributed to such substances have resulted in international actions to eliminate production and present and future uses.

As a result, new alternative technologies and techniques have been sought to provide fire protection for such applications and anyvhere halogenated fluorocarbons have been traditionally used, while preventing further ozone depletion. In the last eight years, several products have emerged to provide niche answers to many of the applications of halogenated fluorocarbons in fire protection. However, such products have not shown the same degree of low toxicity, physical properties and fire extinguishing efficiency and perfonnance in combination as the halogenated fluorocarbons. This lack of equivalent fire extinguishing perfonmance is predominantly due to the lack of chemically active fire extinguishing capability, since the halogen component (the chemically active member) of earlier products has also been attributed as the ozone depleting component. As a result, new envirornentally safe technologies generally cannot utilize such halogens, to avoid their release into the atmosphere. Such new products typically require much more space and weight allowances than the halogenated fluorocarbons they replace. Among these products, only a select few have been approved for use in occupied spaces by regulatory authorities such as the Environmental Protection Agency, since these products tend to have higher toxicities than the halogenated fluorocarbons. These few products with acceptable toxicities for occupied space use suffer from measurable storage space increases over their predecessors, which make additional demands on new installations and can make retrofit systems very difficult. In addition, most of these products have calculated or measured long atmospheric lives, which can contribute to global wanring. This feature currently limits their use in some applications, and they may face further restriction in the future.

A select class of products that do not suffer such toxicity or environmental effects are the compositions of inert gases for fire protection. Traditional pure inert gases, such as nitrogen or carbon dioxide, used by themselves cannot inert and extinguish fires at concentrations that allow humans to function, since they must decrease the oxyg,en concentration below a level that supports human activity. Recent discoveries, however, have shown that blended compositions of such gases can be formulated to support human function while extinguishing fires. One particular composition, labeled IG-541 by the U.S. Environmental Protection Agency Significant New Alternatives Program (SNAP), has achieved such capability by blending a mixture of nitrogen, argon and carbon dioxide in a ratio of 52%:40%:8% respectively to extinguish fires, yet support human activity by increasing the human respiration rate with the addition of carbon dioxide, so that sufficient oxygen can be inhaled in necessary quantities.

This concept has been demonstrated and withstood extensive medical review. This composition is now being widely distributed around the world for enclosed space total flood fire extinguishing systems with the potential for human occupancy. One significant drawback, however, is that the large storag,e spaces required for the compressed gas tanks may require almost ten times the space of previous halogenated fluorocarbon systems. This severely limits its use for many applications and for retrofit into existing installations. Other inert gas compositions exist which suffer from the same limitations.

In summary, a technology is desired that can retain the beneficial features of the inert gas fire extinguishing compositions in terms of human safety, effectiveness and environmental acceptability, while reducing the detrimental feature of large increases in required storage area, to facilitate wider implementation of such technologies. No device has been demonstrated to date that incoiporates all of these features.

SUMMARY OF THE INVENTION

The principal object of the present invention is to provide a system for extinguishing fires in enclosed spaces by means of inert gas compositions.

Another object of the present invention is to provide a system for extinguishing fires in enclosed spaces that allows sustained occupancy of humans.

Another object of the present invention is to provide a system for extinguishing fires in enclosed spaces with minimal storage space requirements.

The foregoing objects can be accomplished by providing a fire extinguishing system for enclosed spaces, comprising a dischargeable container having self-contained therein a composition of inert gas, a solid propellent gas Generator operably connected to a dischargeable container capable of discharging inert gases, means for discharging the inert gases from the dischargeable container and propellent (,as generator operably connected, means operably connected to the discharge means for transmitting the inert gas composition, and means operably connected to the transmitting means for releasing the inert gas composition into an enclosed compartment, the composition having capability of extinguishing fires in the compartment at concentrations that permit sustained human occupancy in said compartment. The system can be stored in volumes significantly smaller than existing inert gas fire extinguishing systems, thus allowing greater application of their use where storage space is limited. This device can satisfy all of the objects stated previously, whereas prior art cannot satisfy all of the objects in their entirety.

DETAILED DESCRIPTION

Figure 1:
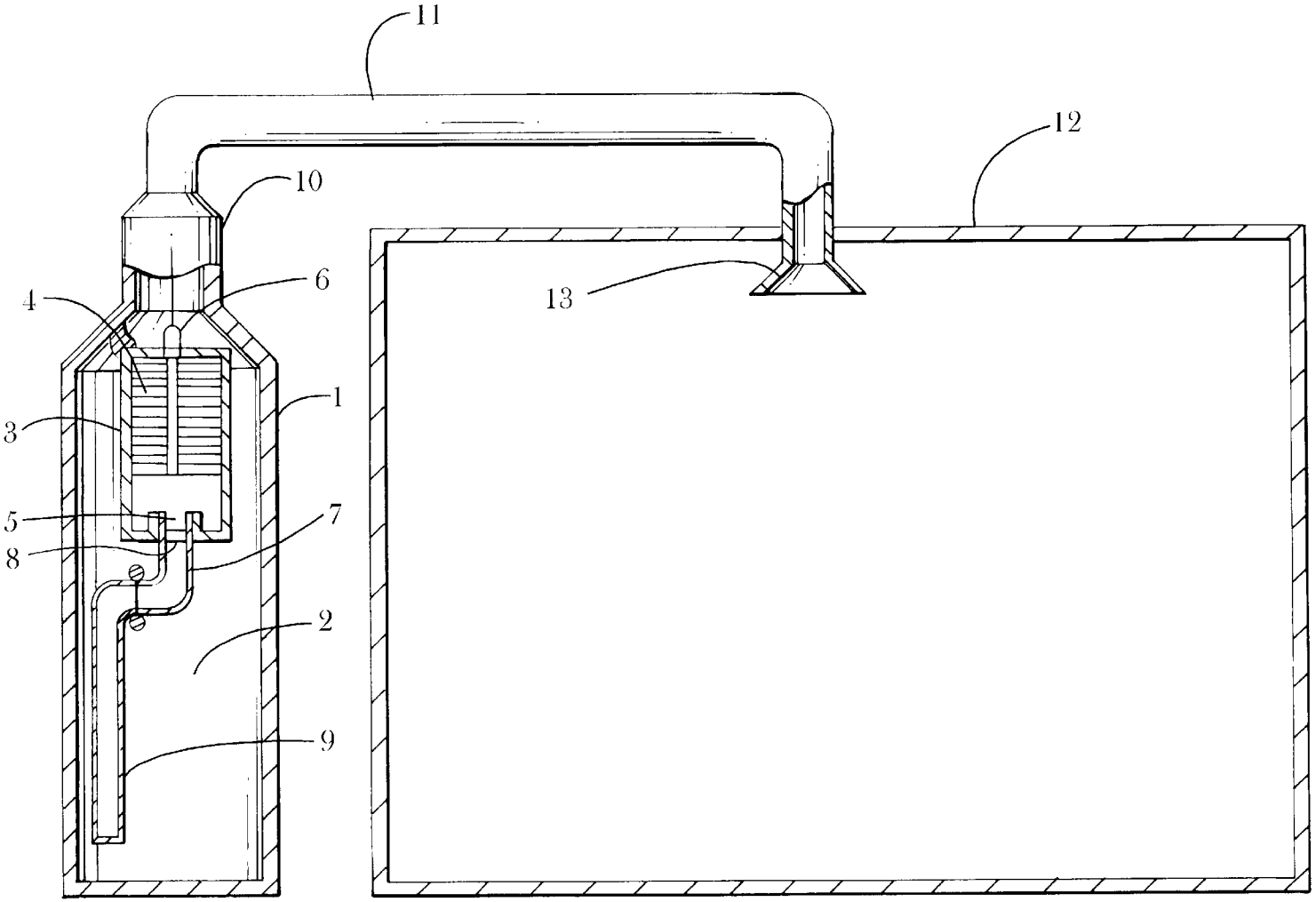
FIG. 1 is a side elevation and section in part of the entire device in accordance with the present Invention.
Figure 2:
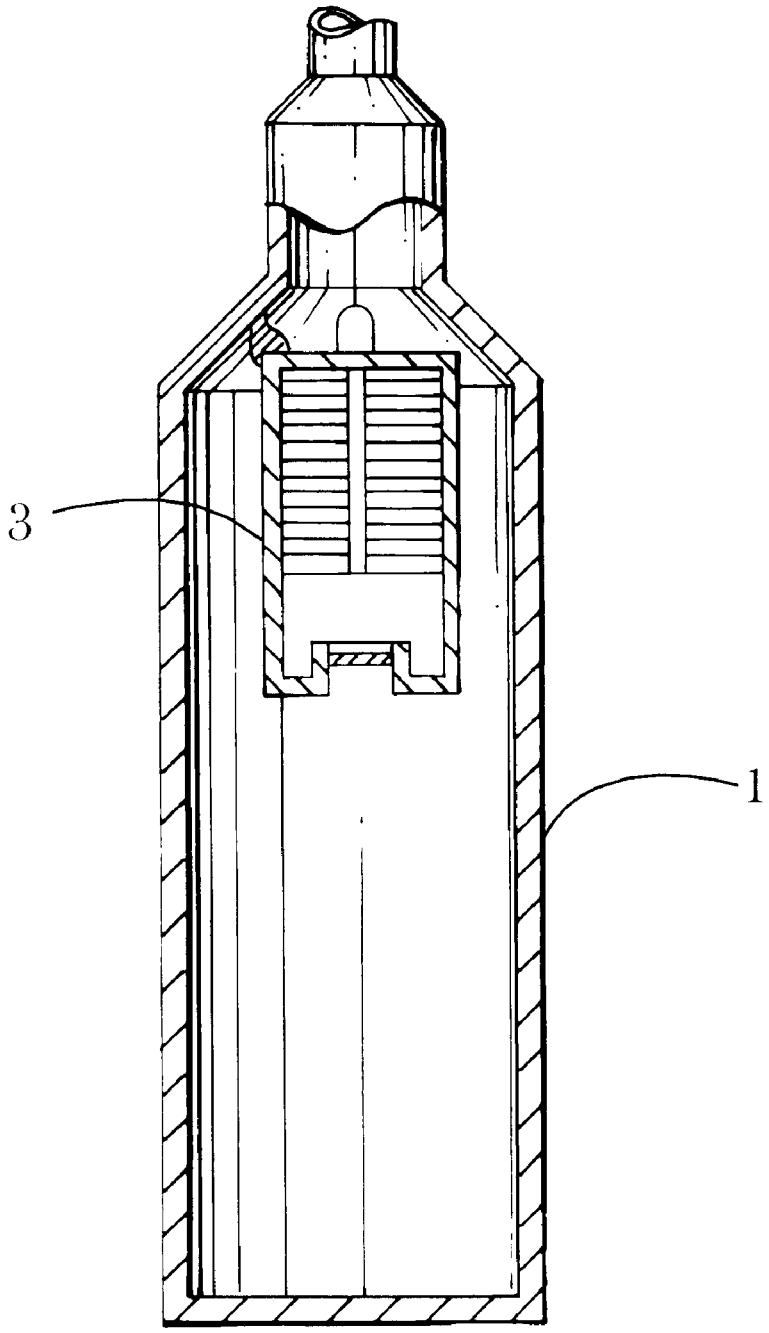
FIG. 2 is a side view of an alternative embodiment of the invention.

Refer now to FIG. 1, which is an overall drawing of the preferred embodiment of the Invention. The device complnses a container 1 which contains a composition of inert gases 2. In the form of the preferred embodiment the invention shall provide inert gas composition labeled IG-541 by the United States Environmental Protection Agency Significant New Alternatives Program (SNAP), which comprises a blend of 52% by volume nitrogen, 40% by volume argon and 8% by volume carbon dioxide. The container 1 contains this blend, with the subtraction of nitrogen in the preferred embodiment; such that the container 1 is correspondingly 52% smaller by volume than a typical IG-541 container designed to protect identical enclosed volumes. A solid propellent gas generator 3 is operably attached to the container 1. The solid propellent gas generator 3 contains special solid propellent 4 designed to generate nitrogen gas 5 when the burning of the propellent 4 is initiated by an electric squib 6 designed to initiate the propellent 4.

In the preferred embodiment the propellent 4 comprises a mixture of sodium azide and sulphur that is universally used in automotive airbag gas inflators and common to those experienced in the art. This composition generates almost pure nitrogen gas in a very inexpensive configuration. Upon initiation and firing of the electric squib 6 (either by automatic or manual initiation of an electric circuit upon detection of a fire in a compartment, and familiar to those experienced in the art), the propellent 4 rapidly burns to gvenerate nitrogen gas 5 which is directed to the container 1 by means of suitable plumbing 7. In the preferred embodiment the exhaust part of the gas generator 3 contains a rupture disk 8 designed to prevent passage of the inert gas composition 2 from the container 1 into the solid propellent gas generator 3, yet rupture upon generation of the higher pressures due to nitrogen gas 5 generated from the initiated solid propellent gas generator 3 to facilitate the release of nitrogen gas 5 from the initiated solid propellent gas generator 3. In the preferred embodiment an optional dip tube 9 is enclosed in the container 1 and operably attached to the plumbing 7 to facilitate release of the nitrogen gas 5 into the lower portion of the internal volume of the container 1. This is designed to promote mixing with the inert composition 2 enclosed in the container 1. A discharge valve 10 facilitates containment of the high pressure inert gas composition 2 and nitrogen gas 5. Upon discharge of the nitrogen (gas 5 from the solid propellent gas generator 3 into the lower portion of the container 1, the discharge valve 10 releases the blended nitrogen gas 5 and the inert gas composition 2 out of the container 1. The discharge valve 10 can be configured to contain a rupture disk designed to rupture at a pressure above the nonnal storagye pressure of the inert gas composition 2 due to the addition of the nitrogen gas 5 from the solid propellent gas generator 3 to facilitate the release of the nitrogen gas 5 and the inert gas composition 2. The blend of nitrogen gas 5 and the inert gas composition 2 moves through a conduit 11 or transport plumbing which is operably connected to the container 1 at the discharge valve 10 and an enclosed compartment 12 where it is released through a discharge nozzle 13. Thus, the blend of nitrogen gas 5 and said inert gas composition 2 is released into the enclosed compartment 12 in which a fire is located, effectively extinguishing the fire upon discharge of the nitrogen gas 5 and the inert gas composition 2 into the compartment 12.

The gas generator units 3 can also be mounted within the compressed inert gas container 1. This arrangement may be more space efficient, and may remove the necessity for additional plumbing 7 or a dip tube 9.

The gas generator unit(s) 3 may be mounted at the end of the conduit 11, near the discharge nozzle(s) 13. In one type of such an arrangement, a cylindrical gas generator may be mounted to surround the conduit that tranports the compressed inert gases stored in the storage cylinder, such as argon, to the enclosed compartment 12 to be protected. The gas generator may initiate at a preset time after the compressed gas storage cylinder is opencd, to discharge the nitrogen and possibly carbon dioxide released by the generator into the conduit as the compressed inert gases pass by, to mix with such gases and result in a blend suitable for extinguishment. Such arrangements permit the use of lower pressure-rated conduits and plumbing between the stored inert gas cylinders and the discharge nozzles, which is a favorable arrangement economically.

Rather than the use of a single gas generator unit for a single inert gas cylinder or bank of cylinders, multiple gas generator units, possibly of unifomn sizes such as those used in automobile airbag inflators, can be mounted to a simple plenum (such as a tube) and attached to the inert gas cylinder. An electronic sequencer (common to those skilled in the art) can be installed to sequentially initiate each of the generators aftcr a preset delay time between initiations, to result in a precise total flow rate through the plenum and cylinder that is desired to mix with the stored inert gas and flow into the conduits. The possible use of such off-the-shelf gas generator units may add considerable economic advantages, as opposed to customized and sized units.

The entire system disclosed in the preferred embodiment or its variations may be discharged into an open area, as opposed to an enclosed compartment. In such an application, the system may function in a manner similar to poltable extinguishers, and may be even scaled in a manner to be portable by human operators.

The solid propellent gTas generator 3 must be sized to generate the appropriate quantity of nitrogen gas 5 to blend with the inert gas composition 2 of argon and carbon dioxide to create a nitrogen, argon and carbon dioxide blend ratio of 52%:40%:8% respectively in the preferred embodiment. The following example will illustrate the substantial volume savings achieved by using the nitrogen stored in solid form in the solid propellent gas generator 3 and supplied to the argon and carbon dioxide in the inert gas composition 2 stored as pressurized gas in the container 1.

EXAMPLE 1

A standard container size for storing IG-541 is 3.8 cubic feet, stored at 2175 pounds per square inch pressure, which will generate 435 cubic feet of inert gas composition upon release into an enclosed atmosphere of approximately 925.5 cubic feet—the estimated enclosure size in which such an amount of extinguishant will provide proper protection and safely extinguish fires. The weight of this inert gas composition is approximately 38.87 pounds mass in this container. Accounting for molecular weights of the different inert gases in the composition, nitrogen accounts for approximately 44.83 percent of the composition weight (or 17.43 pounds mass), argon accounts for approximately 44.33 percent of the composition weight, and carbon dioxide accounts for approximately 10.84 percent of the composition weight. Since the representative volumes of the inert gases are proportional to their relative concentrations, if nitrogen is removed from the composition, the container volume can be reduced by approximately 52 percent. 17.43 pounds of nitrogen must then be added to the remaining argon/carbon dioxide mixture that now requires only 1.82 cubic feet to store.

A solid propellent nitrogen gas generating blend of sodium azide and sulphur containing about 78 to 82 percent sodium azide and about 18 to 22 percent sulfur can generate an almost completely pure nitrogen gas. A standard of blend of about 80.3 percent by weight sodium azide and about 19.7 percent by weight sulphur has been found to be particularly effective (U.S. Pat. No. 3,741,585). By balancing the chemical reaction, a total of 51.89 grams of nitrogen will be produced for every 100 grams of sodium azide/sulphur blend. The density of sulphur is approximately 2.07 grams per cubic centimeter, and the density of sodium azide is approximately 1.846 grams per cubic centimeter, so an estimated average density of the blend, adjusted for the proportion by wei,,ht of each ingredient, is approximately 1.89 grams per cubic centimeter. To generate the 17.43 pounds mass of nitrogen required from the generator, a total of 33.59 pounds mass of the gas (generator propellent blend is required. Using the estimated density of the blend and converting units, a gas generator of 0.29 cubic feet in volume is needed to supply the necessary mass of nitrogen. This is substantially less than the 1.98 cubic feet of nitrogen needed in compressed gas fone. When the gas (venerator volume is added to the argon/carbon dioxide compressed ,as mixture volume, a total volume of 2.11 cubic feet is required, which is a 44.5 percent reduction in required storage volume over a conventional compressed IG-541 inert gas blend system to provide the same level of protection.

The sodium azide nitrogen gas generator system was chosen as the preferred embodiment due to its low cost and wide availability, while retaining the substantial portion of system size reduction available using this technique. Other variations may exist from the preferred embodiment. These include, but are not limited to, the use of other propellent blends that have been recently discovered that produce higher quantities of nitrogen gas per a given mass or volume of a propellent, but current experimentation and limited availability and cost limits their use at this time. In addition, the carbon dioxide component of the inert gas blend can also be generated by a propellent gas generator in a similar fashion and in addition to the nitrogen gas generator to further reduce overall system size. A particular blend of cupric oxalate, potassium perchlorate and other reactants, as detailed in U.S. Pat. No. 3,806,461, Example 1, which is incorporated herein by reference can generate the necessary 4.21 pounds mass of carbon dioxide necessary for the system in Example 1 of this disclosure detailed above in a carbon dioxide gas generator of 0.077 cubic feet, as opposed to the 0.304 cubic feet required for carbon dioxide in compressed gas state. The total space savings of utilizing both the carbon dioxide and nitrogen gas generators in concert with an argon compressed gas tank for the application expressed in Example 1 above is a 50.5 percent reduction in required volume. This extra reduction in required volume may be offset by the increased complexity and expense of a carbon dioxide gas generator.

In the present state of the art requiring argon, which is a noble gas and generally unreactive and nonexistent in a compound state, it is assumed that the argon must remain in compressed gas state unless cryogenically cooled, and the space savin(gs approaches a limit of 60 percent due to the 40 percent requirement of argon in the blend. However, the door remains open for other carbon dioxide and nitrogen generating propellent blends which may become acceptable and thus further reduce the required space for such a system. These space savings will be greatly magnified in more common systems that protect much larger volumes of enclosed spaces in actual practice. Other inert gas blends that provide fire protection capability, e.g., blends containing about 45 to 55 percent by volume nitrogen, about 35 to 55 percent by volume argon, and up to about 10 percent by volume carbon dioxide can also be created using this approach, including one previously approved blend that uses about 50 percent by volume nitrogen and about 50 percent by volume argon. Various techniques exist in the art for initiating the gas generators and controlling and distributing the flow of the inert gases which can be incorporated into the invention disclosed above, including multiple distribution channels and discharge outlets.

There is thus described a novel compact, affordable inert gas fire extinguishing system which meets all of its stated objectives and which overcomes the disadvantages of existing techniques.

The foregoing description of the prefenred embodiment of the invention has been presented for the purposes of illustration and description. It is not intended to be exhaustive or limit the invention to the precise foin disclosed. Many modifications and variations are possible in light of the above teaching. It is intended that the scope of the Invention not be limited by this detailed description, but should include such modifications and valiations within the scope of the claims appended hereto.

I claim:

1. A compact, affordable inert gas fire extinguishing system, said stem comprising:

(a) a dischargeable container having self-contained therein a first inert gas composition, herein said dischargeabe container includes a discharge tube; and (b) means operably connected to said dischargeable container for generating a second inert gas composition from a solid propellent enclosed within said dischargeable container, wherein said second inert gas blend flows into said dischargeable container causing release of said first inert gas blend and second inert gas blend from said dischargeable container.

2. The system according to claim 1, further including initiation means operably connected to said gas generating means.

3. The system according to claim 1, fairther including means operably connected to said dischargeable container for releasing said first inert gas blend self-contained therein said container and said second inert gas blend generated from said solid propellent simultaneously in blended fonn suitable for fire extinguishment in an enclosure while allowing safe human occupancy during discharge.

4. The system according to claim 3, wherein said blended form comprises 52 percent by volume nitrogen, 40 percent by volume argon and 8 percent by volume carbon dioxide.

5. The system according to claim 3, wherein said blended fonn comprises 50 percent by volume argon and 50 percent by volume nitrogen.

6. The system according to claim 4, wherein said first inert gas composition comprises carbon dioxide and argon.

7. The system according to claim 1, wherein said second inert gas composition generated from said generating means includes nitrogen.

8. The system according to claim 7, wherein said solid propellent in said second inert gas composition generating means comprises sodium azide and sulphur.

9. The system according to claim 1, wherein said second inert gas composition generated in said generating means comprises nitrogen and carbon dioxide.

10. The system according to claim 1, further including a dip tube partly disposed in said container and connected to said generating means.

11. The system according to claim 1, wherein said blended form comprises about 45 to 55 percent by volume nitrogen, about 35 to 55 percent by volume argon and up to about 10 percent by volume carbon dioxide.

12. The device according to claim 1, wherein satid inert gas fire extinguishing system is transportable.

13. The device according to claitn 1, wherein said dischargeable container is the distribution plumbing to the discharge nozzle.

14. The device according to claim 1, wherein said first inert gas composition is air.

15. A compact, affordable inert gas fire extinguishing system for an enclosure, said system comprsing:

(a) a dischargeable container having self-contained therein a composition of inert gas, wherein said dischargeable container includes a discharge tube;

(b) a solid propellent nitrogen gas generating means;

(c) initiation means operably connected to said nitrogen gas generating means;

(d) means of enclosing said nitrogen gas generating means within said container;

(e) means operably interconnecting said container and said nitrogen1 gas generating means;

(f) means operably connected to said container for discharging said inert gas composition self-contained thereiin said container and nitrogen generated in said generating means;

(g) means operably connected to said discharging means for releasing said inert gas composition self-contained therein said container aud nitrogen generated in said gas generating means simultaneously in blended form suitable for fire extinguishment in said enclosure while allowing for safe human occupancy during discharge.

16. The systemn according to claim 15, wherein said blended form comprises 52 percent by volume nitrogen, 40 percent by volume argon and 8 percent by volume carbon dioxide.

17. The system according to claim 15, wherein said blended form comprises 50 percent by volume argon and 50 percent by volume nitrogen.

18. The system according to claim 15 wherein said solid propellent in said inert (gas generating means comprises substantially sodium azide and sulphur.

19. The system according to claim 15, wherein said means operably interconnecting said container and said nitrogen gas gcneratin(g means includes a dip tube extended into and partially disposed in said container.

20. The system according to claim 15, wherein said blended form comprises about 45 to 66 percent by volume nitrogen, about 35 to 55 percent by volume argon and up to about 10 percent by volume carbon dioxide.

21. The device according to claim 15, wherein said dischargeable container is the distribution pliunbing to the discharge nozzle.

22. The device according to claim 15, wherein said composition of inert gas is air.

23. A compact, affordable inert gas fire extinguishing system for an enclosure, said system comprising:

(a) dischargeable container having self-contained therein argon, wherein said dischargeable container includes a discharge tube;

(b) a solid propellent nitrogen and carbon dioxide gas generating means;

(c) initiation means operably connected to said nitrogen and carbon dioxide gas generating means within said container;

(d) means emclosing said nitrogen gas generating, means and said carbon d saod carbpm dioxide gas gemerating, means within said container;

(e) means operably interconnecting said container and said nitrogen gas generating means and said carbon dioxide gas generating means;

(f) means operably connected to said container for discharging said argon self-contained therein said container and nitrogen and carbon dioxide generated in said generating means; and (g) means operably connected to said discharging means for releasing said argon self-contained therin said container nitrogen and carbon dioxide generated in said gas generating means simultaneously in blended form suitable for fire extinguishment in said enclosure while allowing for safe human occupancy during discharge.

24. The system according to claim 23, wherein said blended fonn comprises 52 percent by volume nitrogen, 40 percent by volume argon and 8 percent by volume carbon dioxide.

25. The system according to claim 23, wherein said solid propellent in said gas generating means includes at least sodium azide and sulphur.

26. The system according to claim 23 wherein said solid propellent in said gas generating means includes at least cupric oxalate, potassium perchlorate, polyethylene glycol, bitolyl diusocyanate, trimethylol propane and ferric acetyl acetonate.

27. The system according to claim 23, wherein said means operably interconnecting said container and said nitrogen and carbon dioxide gas generating means includes a dip tube extended into and partially disposed in said container.

28. The system according to claim 23, wherein said blended fonnh comprises about 45 to 55 percent by volume nitrogen, about 35 to 55 percent by volume argon and up to about 10 percent by volume carbon dioxide.

29. The device according to claim 23, wherein said dischargeable container is the distribution plumbing to the discharge nozzle.

* * * * *